US006745696B1

(12) United States Patent
Rotkopf

(10) Patent No.: US 6,745,696 B1
(45) Date of Patent: Jun. 8, 2004

(54) ARMOR PIERCING PROJECTILE

(75) Inventor: Menachem Rotkopf, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/700,666

(22) PCT Filed: Mar. 25, 1999

(86) PCT No.: PCT/IL99/00121

§ 371 (c)(1),
(2), (4) Date: Nov. 17, 2000

(87) PCT Pub. No.: WO00/58684

PCT Pub. Date: Oct. 5, 2000

(51) Int. Cl.[7] ..... F42B 15/00

(52) U.S. Cl. ..... 102/376; 102/374; 102/430; 102/520

(58) Field of Search ..... 102/374, 489, 102/517, 518

(56) References Cited

U.S. PATENT DOCUMENTS

| | | | | | |
|---|---|---|---|---|---|
| 3,754,507 | A | * | 8/1973 | Dillinger et al. | 102/374 |
| 3,903,804 | A | * | 9/1975 | Luttrell et al. | |
| 4,102,271 | A | * | 7/1978 | Bethmann | 102/521 |
| 4,127,243 | A | * | 11/1978 | Jacobson et al. | |
| 4,397,240 | A | * | 8/1983 | Rottenberg et al. | 102/376 |
| 4,497,253 | A | * | 2/1985 | Sabranski | 102/476 |
| 4,539,911 | A | * | 9/1985 | Flatau | 102/374 |
| 4,574,702 | A | * | 3/1986 | Brandt | 102/476 |
| 4,597,333 | A | * | 7/1986 | Bocker et al. | |
| 4,630,050 | A | * | 12/1986 | Johnson | 342/62 |
| 4,633,782 | A | * | 1/1987 | Berube et al. | |
| 4,638,737 | A | * | 1/1987 | McIngvale | 102/489 |
| 4,643,099 | A | * | 2/1987 | Luther et al. | |
| 4,706,569 | A | * | 11/1987 | Wallow et al. | |
| H403 | H | * | 1/1988 | Glasser | 102/374 |
| 5,109,774 | A | * | 5/1992 | Deffayet | |
| 5,189,248 | A | * | 2/1993 | Deffayet et al. | |
| 5,363,766 | A | * | 11/1994 | Brandon et al. | |
| 5,400,715 | A | * | 3/1995 | Roach et al. | 102/443 |
| 5,596,166 | A | * | 1/1997 | Gould | |
| 5,728,968 | A | * | 3/1998 | Buzzett et al. | |
| 5,886,289 | A | * | 3/1999 | Nixon et al. | |

FOREIGN PATENT DOCUMENTS

| | | |
|---|---|---|
| DE | DT2427680 | 12/1975 |
| RU | 94019594 | 8/1996 |
| RU | 2108537 | 4/1998 |
| WO | WO90/00244 | 1/1990 |

* cited by examiner

*Primary Examiner*—Michael J. Carone
*Assistant Examiner*—Troy Chambers
(74) *Attorney, Agent, or Firm*—Mark M. Friedman

(57) ABSTRACT

A projectile (100) for piercing armor including a cruise propellant (116) for maintaining a cruise velocity of the projectile. The projectile (100) also includes an acceleration rocket motor (109) activated after launch for accelerating the projectile (100) from the cruise velocity to a penetration velocity, in a final stage of flight of the projectile.

13 Claims, 5 Drawing Sheets

ARMOR PIERCING PROJECTILE

FIELD AND BACKGROUND OF THE INVENTION

The present invention relates to a method and apparatus for penetrating armor and, more particularly, to an armor piercing projectile.

The use of armor to protect a combatant is wide spread on the modern battle field. An armored battle field vehicle, such as a tank, is not only heavily armed, its armor protects the vehicle's crew from exposure to enemy forces. Such armored vehicles pose a high degree of threat to any attacking force. Furthermore, an active protection is often used by armored vehicles to provide further protection. Namely, shields containing water, explosives and a combination thereof are placed on an exterior surface of the armor, such that a substantially equal and opposite force is applied against an impacting projectile, thus reducing the penetrative capability of the impacting projectile.

A defending force, protecting itself with conventional ballistic projectiles, aim such projectiles by means of sights mounted on the barrel of a gun. Similarly, missiles and other small projectiles are designed to be fired at the attacking target. While various attempts have been made to provide accurate projectiles and missiles, enabling the defending force to fire their weapons while keeping a safe distance from the target, all too often the projectiles reach their target with insufficient velocity to penetrate a vehicle's protective armor. Drag caused by air resistance rapidly reduces the velocity of a projectile. In order for a projectile to hit the armored vehicle with a velocity sufficient for the projectile to penetrate the target's armor, the defending force must either move closer to the target or wait for the armored vehicle to move closer to them. The reduction of distance between the defending force and the attacking armored vehicle, exposes the defending force to an ever increasing danger.

Some battle vehicles are so heavily armored, that their armor protects the vehicle's crew from an attack at close proximity. Worse still, modern battle field vehicles often have reactive armor. Even if the modern armored vehicle were to be attacked by a projectile that hits the vehicle's surface with sufficient ability to penetrate its armor, the reactive armor, once triggered, reduces the projectile kinetic energy, preventing any serious damage to the vehicle.

Defending ground forces experience similar problems when encountering armored helicopters and other armored ground attack aircraft.

Ground installations are often similarly hardened to protect themselves against attack. Armored installations often house command and control centers operating surface to air installations hostile to aircraft flying overhead. In order to neutralize such a threat, an attacking aircraft launches either free falling ordnance or missiles at the target, only to discover the same problem posed by the tank. Indeed, 'air-strikes ' are designed to assist a defending force often prove to be ineffectual against an armored vehicle. The cruise speed of air to surface arms being too low to provide sufficient force to penetrate a target's armor.

There is thus a widely recognized need for, and it would be highly advantageous to have, a long range projectile that impacts its target at penetrating velocity and more particularly, for a high velocity armor piercing shell.

SUMMARY OF THE INVENTION

According to the present invention there is provided a projectile for piercing armor. The projectile includes an acceleration rocket motor, for driving the projectile from a cruise velocity to a penetration velocity after the projectile has been launched. The penetration velocity is reached when the projectile impacts with its target. The projectile includes a cruising rocket motor to maintain the projectile's cruise velocity.

According to one embodiment of the present invention, the projectile is a missile.

According to another embodiment of the present invention, the projectile is a shell. Preferably the shell is launched from a tank.

According to a preferred embodiment of the present invention, the projectile further includes an armor piercing rod seated within the projectile for piercing armor.

According to still further features in the described preferred embodiments, the projectile further includes at least one countermeasure to a reacting target. Preferably the countermeasure includes an advance projectile associated with the projectile, for neutralizing a target's reactive armor. In one embodiment, the advance projectile is a bullet.

According to another embodiment, the projectile further includes an electronic system to alter the projectile's trajectory during flight.

The present invention successfully addresses the shortcomings of the presently known configurations by providing a long range projectile that can strike its target at a sufficiently high speed to penetrate armor.

The present invention discloses a novel method for piercing armor. The method includes the steps of launching a projectile at a target; increasing the projectile's velocity so as to reach a suitable penetration velocity and striking the target with the projectile at the penetrating velocity.

According to one embodiment of the present invention, the method includes the step of maintaining the cruise velocity of the projectile by the cruise motor to reduce deflection of the projectile by side wind, prior to increasing the velocity of the projectile to its impact penetration velocity.

According to one embodiment of the present invention, the method includes penetrating a target's armor with a portion of the projectile, such as by an armor piercing rod seated in the projectile.

According to another embodiment of the present invention, the method further includes employing countermeasures against a reacting target prior to the projectile striking the target.

BRIEF DESCRIPTION OF THE DRAWINGS

The invention is herein described, by way of example only, with reference to the accompanying drawing in which similar reference numbers have been used throughout to designate similar parts, wherein.

DESCRIPTION OF THE PREFERRED EMBODIMENTS

The present invention relates to a projectile that impacts upon its target at a penetrating velocity. The velocity of the projectile is maintained by a cruise rocket motor at a cruise velocity, the speed of the projectile is then increased by an acceleration rocket motor to a suitable penetrating velocity shortly before impacting upon its target. Specifically, the present invention can be used to provide an armor piercing shell or missile.

For the purposes of the present description and appended claims, a penetrating velocity includes, by way of example only a velocity that allows a projectile, upon impacting a target, to penetrate the target.

An acceleration rocket motor includes, but is not limited to, a rocket propellant, that when ignited, increases the speed of a projectile to a penetrating velocity.

A cruise rocket motor includes, but is not limited to a propellant, that when ignited, maintains a cruise velocity of a projectile in flight, while a cruise velocity includes, but is not limited to, substantially any velocity which maintains the projectile's initial launch flight velocity. It will be appreciated that in certain circumstances, a rocket motor can consist only of a rocket propellant.

The principles and operation of a projectile according to the present invention may be better understood with reference to the drawings and the accompanying description.

Figure 1A:
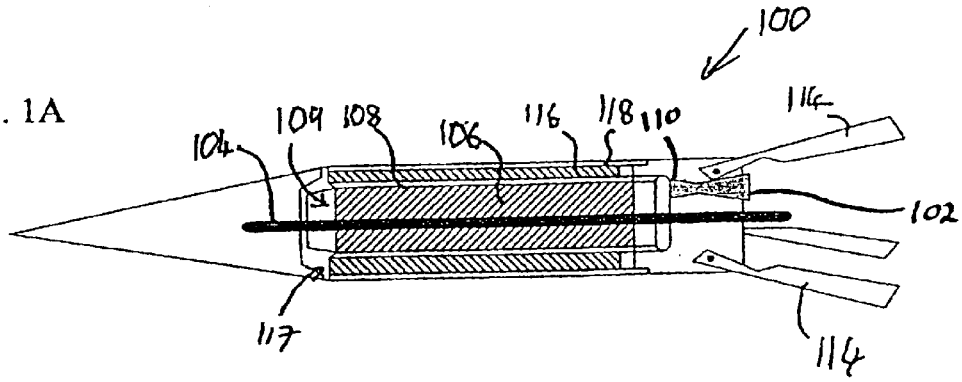
FIG. 1*a* is a schematic cross-section of a projectile according to one embodiment of the present invention wherein the projectile is a shell.
Figure 1B:
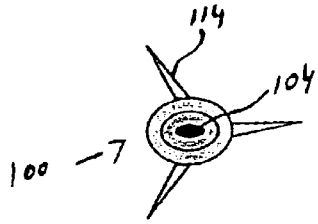
FIG. 1*b* is a cross sectional schematic diagram of the projectile of FIG. 1*a;*
Figure 1C:
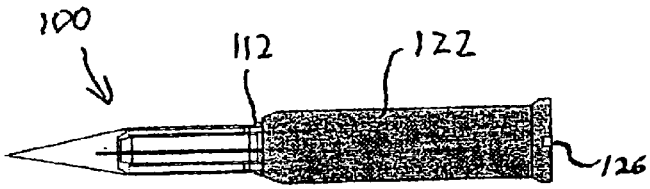
FIG. 1*c* is a schematic diagram of a shell according to one embodiment of the present invention prior to launch.

Referring now to the drawings, FIGS. 1*a*–1*c* illustrate a shell 100 constructed according to one embodiment of the present invention. In this embodiment, shell 100 may, by way of example only, be launched from a tank or a cannon.

Shell 100 includes an acceleration propellant 106 annularly concentric to a cruise propellant 116 and an armor piercing rod 104.

Acceleration propellant 106 contained within an inner housing 108 defines an acceleration rocket motor 109. Motor 109 provides a high thrust impulse to shell 100. Propellant 106 can be ignited at a later flight stage of shell 100 and prior to shell 100 impacting its target. In order for maximum acceleration be achieved, from propellant 106, in a short amount of time, it is preferable for propellant 106 to be quick burning.

At least one nozzle 102 is located at one end of shell 100. Nozzle 102 allows hot high pressure gas produced by the burning of propellant 106 to escape. Preferably, nozzle 102 is enclosed within a nozzle housing 110.

Armor piercing rod 104 is seated in a sleeve (not shown) disposed along the vertical axis of missile 100. Rod 104 is preferably long, narrow and sharply shaped to concentrate, upon impacting a target, a penetrating force within as small an area as possible. Rod 104 may be made from a variety of materials including, but not limited to: high strength steel, tungsten alloys, and the like.

Preferably, shell 100 has a multiplicity of stabilizers 114, as shown in FIG. 1. Stabilizers 114 increase the aerodynamic stability of shell 100 during flight. Stabilizers 114 preferably deploy once shell 100 has been launched.

As illustrated, shell 100 further includes a propellant 116, located within a second housing 118 annularly concentric to propellant 106, thereby defining a cruising rocket motor 117. Motor 117 provides shell 100 with an impulse over a relatively long duration of time. Propellant 116 can be ignited either at the launch of missile, or preferably at a latter point in the missiles flight, once shell 100 has reached its cruise velocity. Preferably, propellant 116 is slow burning. Slow burning propellants usually provide a low amount of thrust sufficient to maintain shell 100 at its cruise velocity, increasing the range of shell 100. It is a particular feature of the present invention that cruise motor 117 while maintaining the velocity of shell 100 increases accuracy of shell 100 over larger ranges by minimizing the influence of deflecting vectors such as cross winds.

As shown in FIG. 1*c*, shell 100 is coupled by seal 112 to a cartridge 122 containing a launch propellant (not shown) and a primer 126. Primer 126, by way of example only, can be initiated by percussion or electrical current.

Figure 3:
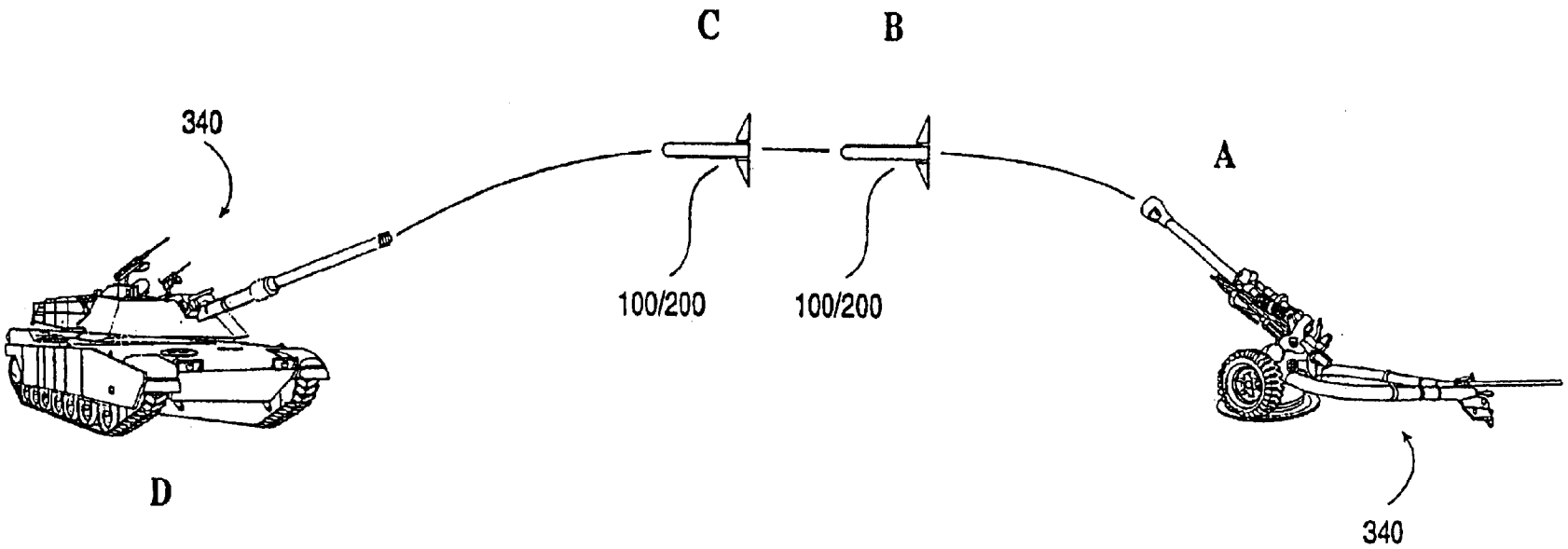
FIG. 3 is a schematic diagram of a shell deployed according to one embodiment of the present invention.

Operation of the missile according to the present invention is as follows: Shell 100 is fired from the gun of a tank, as illustrated in FIG. 3. Alternatively, shell 100 can be fired by an artillery gun 338, in the direction of a target 340. Triggered primer 126 causes launch propellant, contained in cartridge 122 to burn, resulting in a sudden increase in pressure in shell 100. The force of the pressure in gun 338 carries 100 out of gun 338 at a muzzle velocity. This explosion also ignites cruise propellant 116 (FIG. 1*a*) of cruise rocket motor 117. The impulse created by motor 117 maintains shell 100 at a cruise velocity, while stabilizers 114 maintain the stability of shell 100.

Prior to shell 100 impacting upon an armored target, impacting upon armored target 340 of FIG. 3, acceleration propellant 106 of acceleration rocket motor 109 is ignited. Propellant 106 may be ignited in any conventional manner, including but not limited to propellant 116 burning its way through housing 108. Alternatively, propellant 106 can either be ignited, at a time pre-set by the weapons operator, by a signal from a proximity sensor located in the front of shell 100, or substantially at the moment shell 100 is launched. Motor 109 increases the velocity of motor 100 to its penetration velocity, thereby enabling shell 100 to strike target 340 of FIG. 3 at penetration velocity. The force of shell 100 together with the momentum of rod 104, gained during the flight of rod 104, drive rod 104 into the armor of target 340 until the armor of target 340 is penetrated. Optionally motor 109 can be set to reach an adequate penetration velocity to perforate the target.

Figure 2:
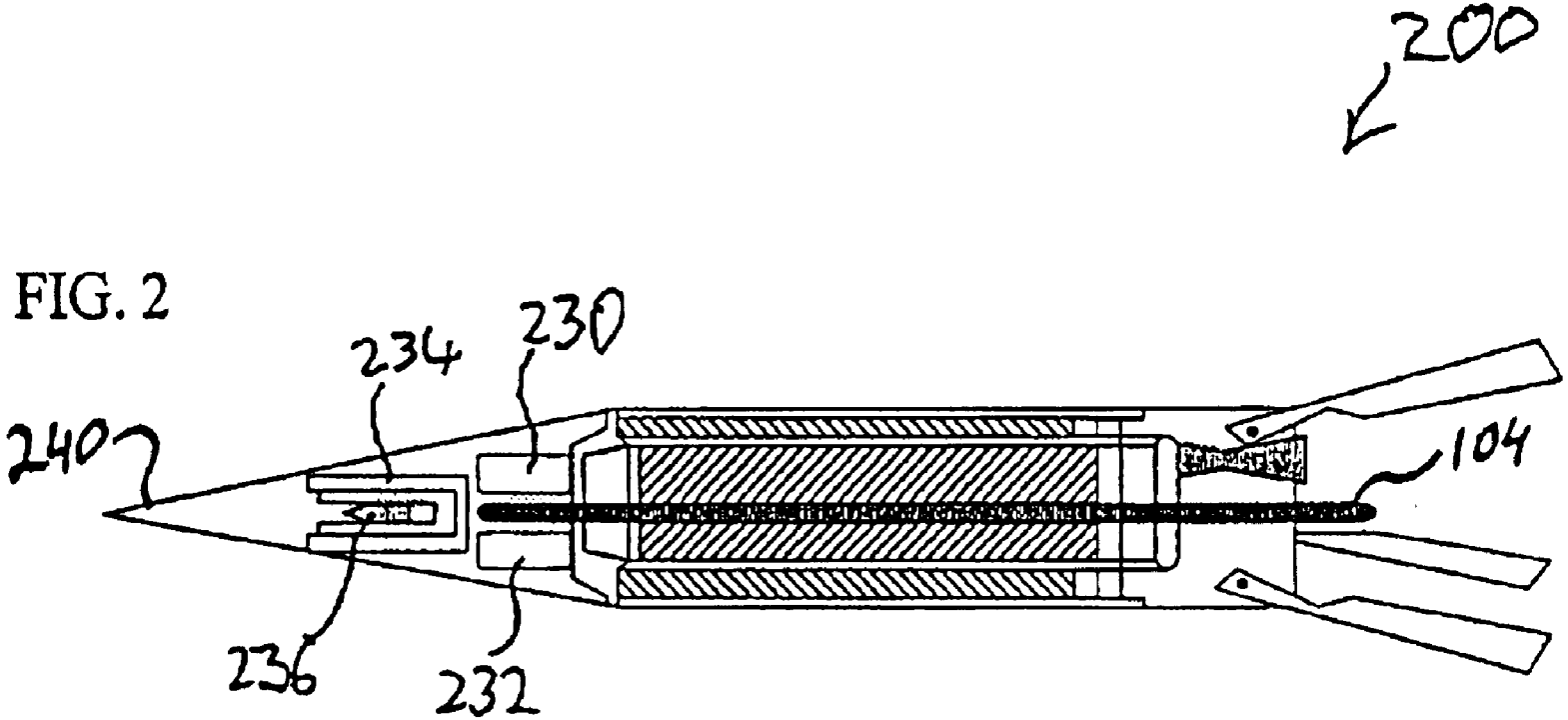
FIG. 2 is a schematic diagram of a shell according to a further embodiment of the present invention.

Reference is now made to FIG. 2, which is a detailed illustrations of a shell 200 constructed and operated according to a further embodiment of the present invention.

In this embodiment, a shell 200 having a cone 240 further includes a communication system having a receiver 230 and a transmitter 232 located in cone region 240 of shell 200. It is an advantage of this configuration that the shell's operator is provided with an opportunity to transmit in-flight instructions to receiver 230 in response to received on-board flight information transmitted by transmitter 232. Optionally, receiver 230 and transmitter 232 can be replaced with a transceiver (not shown), thereby economizing on communication equipment space.

It will be appreciated that a communications system enables the operator to communicate with shell 200, should the operator wish to alter the flight path of shell 200.

Shell 200 also preferably includes an on-board apparatus to neutralize a protective device on targets. As shown in FIG. 2, shell 200 further includes a small projectile launching device 234, associated with shell 200, for firing an advance neutralizing projectile 236 at armored targets. Device 234 fires advance projectile 236 either prior to the moment shell 200 hits target 340 of FIG. 3 or at the moment shell 200 hits target 340. An advantage of this embodiment is that advance projectile 236 triggers any reactive armor target 340 of FIG. 3 may have, thereby leaving target 340 substantially unprotected when shell 200 impacts target 340, thus enabling a greater penetration depth of rod 104.

Operation of the embodiment of FIG. 2 is as follows: As shown in FIG. 3, shell 200 is fired, as described above, from a tank gun 338, or from any artillery gun, which by way of example only, may include a 155 mm or a howitzer, in the direction of target 340. Shell 200 leaves gun 338 at point "A" having a muzzle velocity. At a point "B", in the flight of shell 200, propellant 116 is ignited, altering the velocity of shell 200 to a cruise velocity. As shell 200 nears target 340, and shell 200 reaches point "C", propellant 106 is ignited at a sufficient distance for enabling the velocity of shell 200 to be altered to substantially a penetrating velocity. Preferably, propellant 106 and propellant 116 are ignited, as described above, at times predetermined by the operator. Prior to, and at a short distance from, shell 200 impacting target 340, device 234 is triggered to fire projectile 236 at target 340, thus triggering any reactive armor present. Substantially shortly thereafter, rod 104 penetrates the armor of target 340 as described above.

Figure 4:
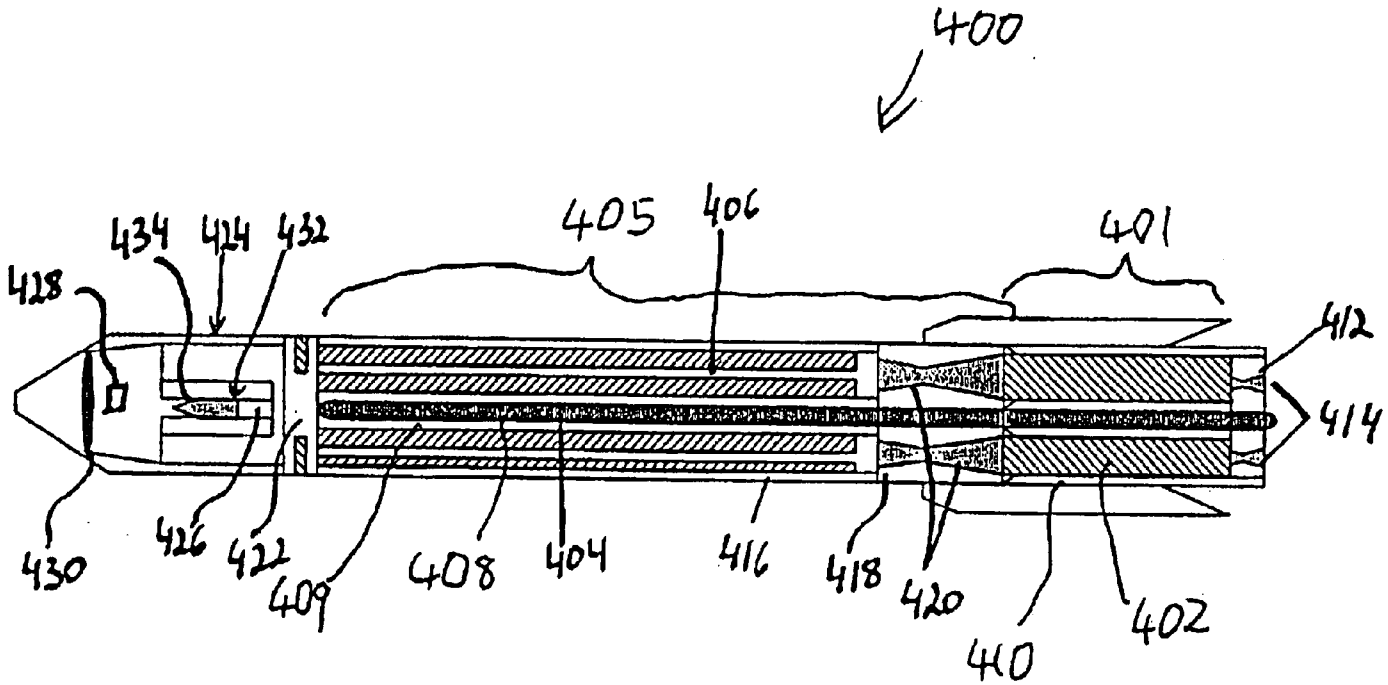
FIG. 4 is a schematic diagram of a missile according to an alternative embodiment of the present invention.

Reference is now made to FIG. 4, which is a detailed illustration of a projectile constructed according to an alternative embodiment of the present invention. In this alternative embodiment, the projectile is an armor piercing missile 400.

Missile 400 has a cruising rocket motor, generally designated 401, in axial series with an acceleration rocket motor, generally designated 405 and an armor piercing rod 408, located in a sleeve 409 disposed along the vertical axis of missile 400. Rod 408 is also similar to armor piercing rods 104 described in earlier embodiments. Cruise motor 401 includes a cruising propellant 402, located within a housing 410 between a nozzle housing 412 and cruising propellant 402. Motor 401 provides an impulse for propelling missile 400 at a cruising velocity. As shown, a nozzle 414, located within housing 412, is positioned adjacent to propellant 402 to receive hot gases from the combustion of propellant 402. Nozzle 414 directs the flow of hot gases out of acceleration motor 401, thus propelling missile 400 at cruise velocity.

Motor 405 is disposed between a compartment 424 and cruise motor 401. Motor 405 includes an acceleration propellant 406, located within housing 416 and a second nozzle housing 418, including at least one nozzle 420. Acceleration propellant 406 is annular shaped having a channel 404. Channel 404 runs down the center of propellant 406. Propellant 406 burns at the center of channel 404 such that channel 404 becomes a combustion chamber providing a larger surface area for propellant 406 to burn. By providing a larger surface area for propellant 406 to burn a greater volume of hot gases is produced for displacing missile 400 forward at a substantially increased velocity than cruise velocity.

In this embodiment, once motor 401 is spent, motor 401 can be discarded in mid-flight by detaching motor 401 from the rest of missile 400. It is an advantage of this embodiment that missile 400 has less mass being displaced by acceleration velocity by motor 405.

As shown, missile 400 further includes an electronic system 426 located between a guidance system 422 and a sensor 428.

Sensor 428, located adjacent to a sensor dome 430, receives target signals such as a radar signal or heat radiation emitting from targets. Received target signals are then transmitted to electronics system 426. Electronics system 426 processes signals received from sensor 428. These signals are used to calculate the position and distance of target 536 of FIG. 5 in relation to missile 400. This information is transmitted to guidance system 422, located in compartment 424, which determines if the trajectory and velocity of missile 400 should be altered as described in earlier embodiments of the present invention.

Figure 5:
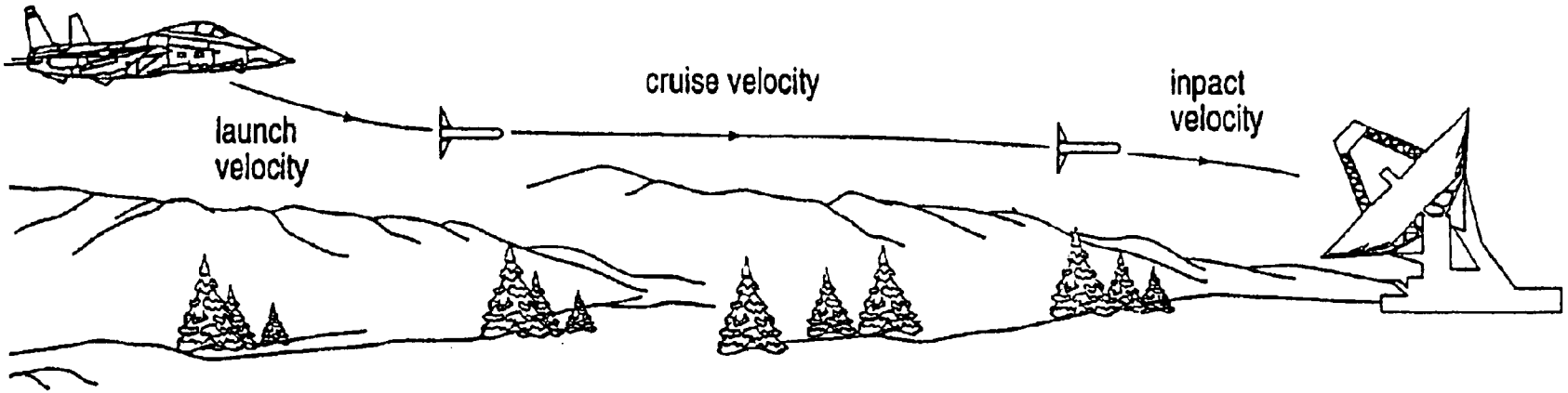
FIG. 5 is a schematic diagram of a missile deployed according to another embodiment of the present invention.

It is an advantage of the present configuration that information concerning position and distance of target 536 of FIG. 5 in relation to missile 400 not only enables the optimal moment to ignite acceleration propellant 406, but also enables the optimal moment of launching of an advance neutralizing projectile 434.

As described in earlier embodiments, missile 400 also includes small projectile 434, to be fired prior to missile 400 hitting target 536, which projectile 536 is disposed within a device 432. Device 432 is disposed between sensor 428 and compartment 424.

Missile 400 can be launched from an aircraft such as an attack aircraft 535, as shown in FIG. 5. Alternatively missile 400 can be launched from a ground based platform. Optionally, missile 400 could be fired by a mobile platform, an airborne gunship or a sea going vessel.

Operation of missile 400 is as follows:

As illustrated in FIG. 5, missile 400 is released from aircraft 535 at a release velocity, as shown in FIG. 5, from an aircraft 535 at a release velocity, substantially contemporaneously with igniting propellant 402 of motor 401 (FIG. 4). Motor 401 drives missile 400 from point "A" (FIG. 5) to a cruise velocity.

A target which can include by way of example only, a ship, a tank, an artillery station, a radar installation, any ground target, and even an airborne gunship is identified by sensor 428 (FIG. 4). Target information is then transmitted to system 426 which transmits updated target location information to guidance system 422. System 422 then determines whether the trajectory of missile 400 should be altered.

As shown in FIG. 5, as missile 400 approaches target 536, the optimal distance to target 536, in relation to missile 400, is determined for igniting propellant 406. Al this optimal distance marked "B", propellant 406 (FIG. 4) is ignited, motor 401 is detached and motor 405 accelerates missile 400 to substantially a penetration velocity.

As described in earlier embodiments, advance neutralizing missile 434 is fired at the target 536 prior to missile 400 impacting target 536, thus neutralizing the reactive armor of target 536. Missile 400 then strikes and penetrates the armor of target 536 as described above.

While the invention has been described with respect to a limited number of embodiments, it will be appreciated that many variations, modifications and other applications of the invention may be made.

What is claimed is:

1. A projectile device for piercing armor, the projectile device being fired from the barrel of a gun, the projectile device comprising:

(a) a shell; and (b) a cartridge associated with said shell prior to firing, said cartridge containing a launch propellant for accelerating said shell along the barrel of the gun to a muzzle velocity, wherein said shell includes:

(i) a cruise rocket motor configured for maintaining a substantially constant cruise velocity of said shell for a first period after leaving the barrel of the gun; and (ii) an acceleration rocket motor configured for accelerating said shell from said cruise velocity to a penetration velocity in a final stage of flight of the shell.

2. The projectile device of claim 1, further comprising an armor-piercing rod situated within said shell for piercing armor.

3. The projectile device of claim 2, further comprising a penetrating device coupled to said shell for penetrating a reactive target having reactive armor.

4. The projectile device of claim 3, wherein said penetrating device includes an advance projectile associated with said shell, for neutralizing reactive armor of a target.

5. The projectile device of claim 4, wherein said advanced projectile is a bullet.

6. The projectile device of claim 1, further comprising an electronic system associated with said shell for altering a trajectory of said shell during flight of said shell.

7. The projectile device of claim 6, wherein said electronic system further comprises:

(a) a sensor, for detecting a target; and (b) a guidance system for controlling the trajectory of said shell.

8. The projectile device of claim 7, wherein said sensor is responsive to a radar signal.

9. The projectile device of claim 7, wherein said sensor is responsive to radiation emission of said target.

10. The projectile device of claim 1, wherein said cruise rocket motor is activated substantially at the beginning of flight of the projectile.

11. A method for propelling a shell fired from the barrel of a gun to pierce armor of a target, the method comprising:

(a) employing launch propellant for accelerating the shell along the barrel of the gun to a muzzle velocity, said launch propellant being located within a cartridge associated with the shell prior to firing;

(b) employing a cruise rocket motor located within the shell for maintaining a substantially constant cruise velocity of the shell for a first period after leaving the barrel of the gun; and (c) employing an acceleration rocket motor located within the the shell for accelerating the shell from said cruise velocity to a penetration velocity in a final stage of flight of the shell.

12. The method of claim 11, further comprising the step of penetrating armor of the target with the shell.

13. The method of claim 12, further comprising the step of neutralizing reactive armor of said target prior to said penetrating.

* * * * *